US006851790B2

(12) United States Patent
Tominaga

(10) Patent No.: US 6,851,790 B2
(45) Date of Patent: Feb. 8, 2005

(54) INK JET HEAD, INK JET RECORDING APPARATUS, AND METHOD FOR REMOVING DUST FROM THE INK JET HEAD

(75) Inventor: Kazuyoshi Tominaga, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/016,911

(22) Filed: Dec. 13, 2001

(65) Prior Publication Data

US 2002/0149643 A1 Oct. 17, 2002

(30) Foreign Application Priority Data

Jan. 11, 2001 (JP) ..... 2001-004062

(51) Int. Cl.[7] ..... B41J 2/15; B41J 2/015
(52) U.S. Cl. ..... 347/40; 347/20
(58) Field of Search ..... 347/20, 22, 23, 347/29, 31, 33, 34, 40, 42, 84, 85, 93, 92

(56) References Cited

U.S. PATENT DOCUMENTS 6,109,740 A * 8/2000 Namekawa et al. ..... 347/85
6,196,655 B1 * 3/2001 Hirasawa et al. ..... 347/25
6,361,151 B1 * 3/2002 Shigemura ..... 347/68

FOREIGN PATENT DOCUMENTS

JP 405229116 A * 9/1993 ..... 347/69

* cited by examiner

*Primary Examiner*—Kristal Feggins
*Assistant Examiner*—An H. Do
(74) *Attorney, Agent, or Firm*—Adams & Wilks

(57) ABSTRACT

An ink jet head has a substrate, partition walls disposed on a main surface of the substrate and spaced apart at a preselected interval to form channels for receiving ink. An ink chamber plate is connected to the substrate to define with the partition walls an ink chamber for supplying ink to the channels. A passage forming member is connected to the ink chamber plate and has an ink supply passage disposed in communication with the ink chamber for supplying ink contained in an ink storage device to the ink chamber and at least one ink discharge passage for discharging ink from the ink chamber. The ink discharge passage is independent from the ink supply passage so that ink is supplied directly to the ink chamber through the ink supply passage without passing through at least a portion of the ink discharge passage.

18 Claims, 7 Drawing Sheets

INK JET HEAD, INK JET RECORDING APPARATUS, AND METHOD FOR REMOVING DUST FROM THE INK JET HEAD

BACKGROUND OF THE INVENTION

1. Field of the Invention

The present invention relates to an ink jet head and an ink jet recording apparatus that prints by discharging ink droplets through nozzle apertures, and to a method for removing unwanted substances including dust particles and bubbles from the ink jet head.

2. Description of the Related Art

There is known a conventional ink jet recording apparatus that records characters and images on a recording medium by using an ink jet head having a plurality of nozzles for discharging ink. In this ink jet recording apparatus, the nozzles of the ink jet head are formed in a head holder in such a position as to face the recording medium. The head holder is mounted on a carriage and performs scanning in a direction perpendicular to a transport direction of the recording medium.

FIG. 7 is an exploded schematic diagram showing an example of such an ink jet head. As shown in FIG. 7, a plurality of grooves 102 are formed in parallel in a piezo-ceramic plate 101, and the grooves 102 are separated by side walls 103. One end portion of each groove 102 in the longitudinal direction extends up to one end face of the piezo-ceramic plate 101, whereas the other end portion of each groove 102 does not extend up to the other end face of the piezo-ceramic plate 101 and gradually decreases in depth. Electrodes 105 for applying drive voltages are formed in the opening-side surfaces of both side walls 103 of each groove 102 so as to extend in the longitudinal direction thereof.

An ink chamber forming substrate 107, which forms an ink chamber 106 communicating with the end portion of each groove 102 where the depth is decreased, is joined to the piezo-ceramic plate 101 on the side where the grooves 102 are opened. Further, a passage forming member 109, which seals one side of the ink chamber 106 and has an ink supply passage 108 for supplying ink to the ink chamber 106, is fixed to the ink chamber forming substrate 107.

A nozzle plate 110 is joined to the end face of the joined body of the piezo-ceramic plate 101 and the ink chamber forming substrate 107 on the side where the grooves 102 are opened. Nozzle apertures 111 are formed in the nozzle plate 110 in such positions as to face the respective grooves 102 of the nozzle plate 110.

In the recording head that is constructed in the above-mentioned manner, when the ink is supplied to the grooves 102 via the ink supply passage 10 and predetermined driving electric fields are applied to both side walls 103 of a predetermined groove 102 through the electrodes 105, the side walls 103 are deformed to change the capacity of the predetermined groove 102 so that the ink can be discharged from the groove 102 through the nozzle aperture 111.

The above-described ink jet head is disadvantageous because the ink cannot be satisfactorily discharged due to dust, bubbles, etc. in the ink. To address this problem, a filter 112 is usually provided at the end of the ink supply passage 108 by the side of the ink chamber 106 so as to prevent dust and bubbles in the ink from entering the ink chamber 106.

Although the use of the filter 112 can prevent the entry of dust and bubbles of a certain size, it is difficult to completely prevent the entry of dust and bubbles. Although the use of a finely meshed filter would prevent the entry of dust to a larger degree, such a filter disturbs the flow of ink. It is therefore impossible to use a finely meshed filter.

Dust which passes through the filter 112 is removed by a so-called cleaning operation in which the ink contained in the grooves 102 and the ink chamber 106 is absorbed through the nozzle apertures 111. This cleaning operation, however, cannot completely remove the dust. The head from which the dust has not been removed must be disposed of.

SUMMARY OF THE INVENTION

It is therefore an object of the present invention to provide an ink jet head and an ink jet recording apparatus that are capable of removing dust therein reliably and relatively easily, and a method for removing dust from the head.

To accomplish the above object, according to the first mode of the present invention, there is provided an ink jet head, which comprises a plurality of chambers being in communication with nozzle apertures and an ink chamber for supplying ink to the chambers, and which changes the capacity of the chambers to discharge ink contained in the chambers through the nozzle apertures, the ink jet head comprising a passage forming member having an ink supply passage constituting a part of a passage connecting an ink storage means storing ink therein to the ink chamber, the passage forming member having at least one communicating passage capable of discharging the ink from the ink chamber.

According to the second mode of the present invention, with the above arrangement in the first mode, the communicating passage is formed in each of regions in proximity to both ends of the ink chamber in the longitudinal direction.

According to the third mode of the present invention, with the above arrangement in the first mode, the communicating passage has a check valve permitting only a flow from the ink chamber to outside.

According to the fourth mode of the present invention, with the above arrangement in the first mode, the communicating passage is sealed by securing a cap member to the passage forming member through an O-ring.

According to the fifth mode of the present invention, with the above arrangement in the first mode, a filter is provided between the ink supply passage and the ink chamber, and ink is supplied from the ink storage means to the ink chamber through the filter.

According to the sixth mode of the present invention, the present invention also provides an ink jet recording apparatus having the ink jet head with the above arrangement in the mode, the ink jet recording apparatus comprising absorbing means connected to the communicating passage, the absorbing means absorbing ink in the ink chamber through the communicating passage.

According to the seventh mode of the present invention, there is provided a head dust removing method for removing dust in a passage of an ink jet head which comprises a plurality of chambers connected to nozzle apertures, an ink chamber for supplying ink to the chambers, and a plurality of communicating passages capable of discharging the ink from the ink chamber, the method comprising: a stirring step of absorbing the ink in the ink chamber through the communicating passages with different timings and stirring the ink in the ink chamber; and a discharging step of absorbing ink including dust in the ink chamber and discharging the same to outside.

According to the eighth mode of the present invention, with the above arrangement in the seventh mode, the communicating passages are formed in respective regions corresponding to both ends of the ink chamber in the longitudinal direction, and the stirring step comprises absorbing the ink in the ink chamber through the communicating passages alternately.

According to the present invention, the ink contained in the ink chamber is absorbed and discharged through the communicating passages formed in the passage forming member. This makes it possible to remove the dust from the ink reliably and relatively easily.

DETAILED DESCRIPTION OF THE PREFERRED EMBODIMENTS

The present invention will now be described in detail with reference to the drawings showing an embodiment thereof.

Figure 1:
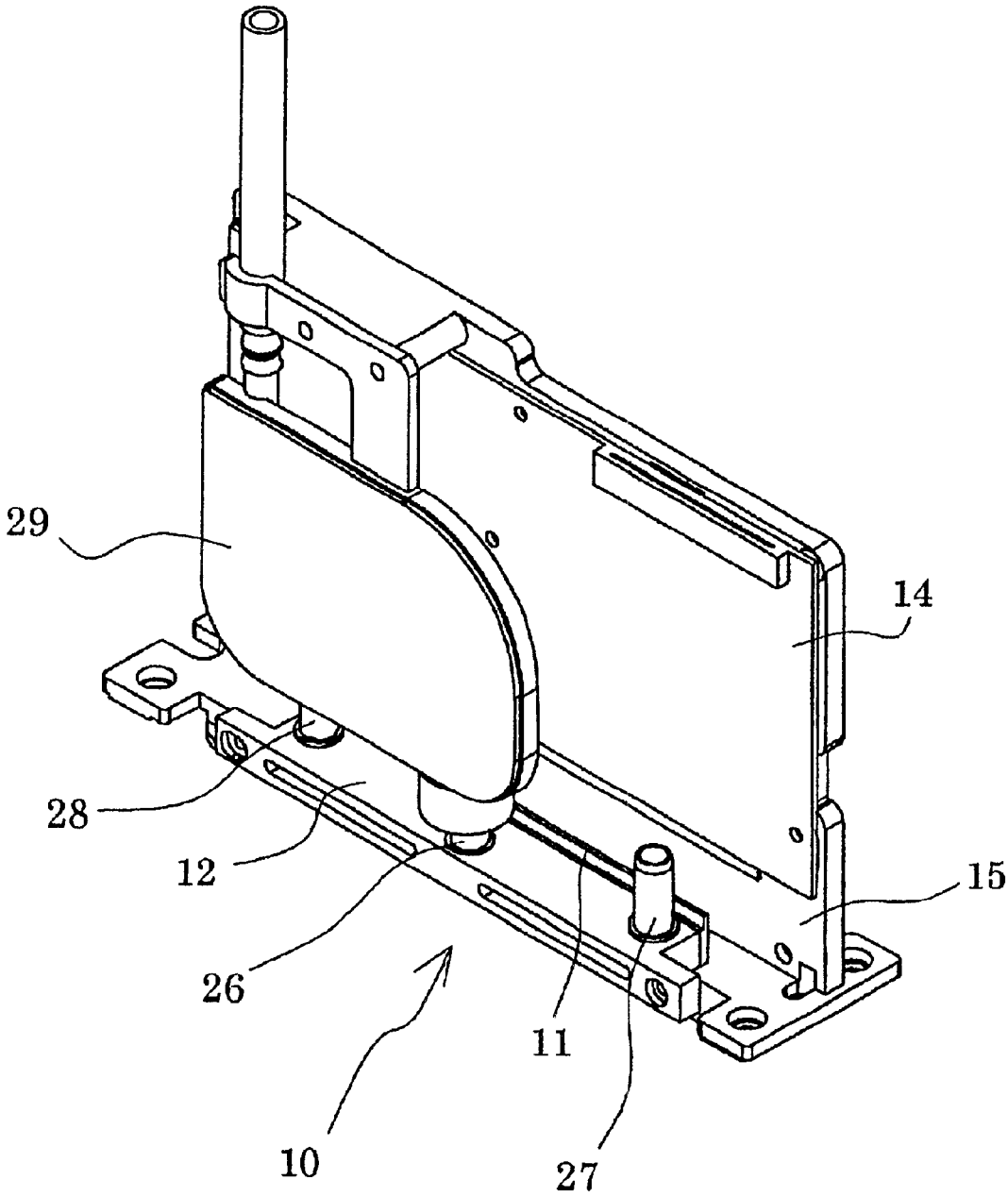
FIG. 1 is an assembly perspective view showing an ink jet head according to an embodiment of the present invention.
Figure 2:
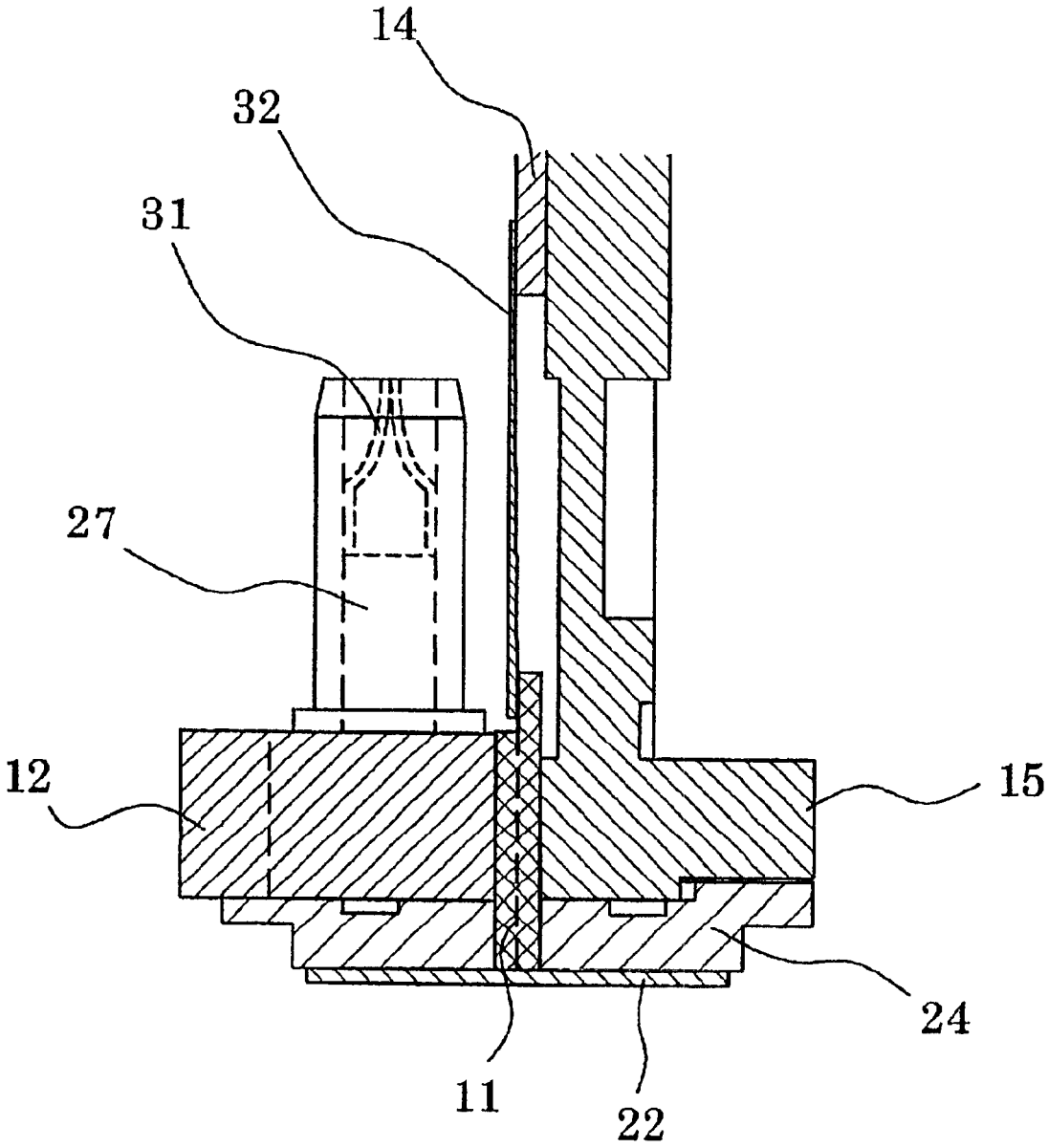
FIG. 2 is a sectional view showing a principal part of an ink jet head according to an embodiment of the present invention.
Figure 3:
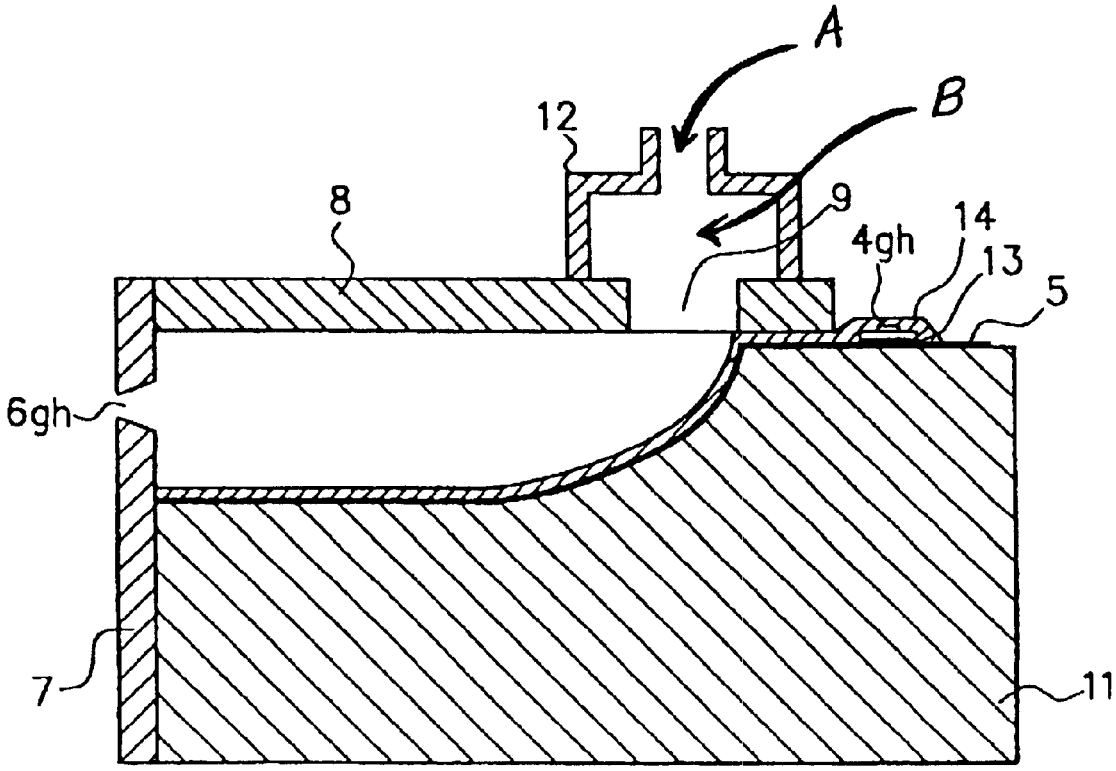
FIG. 3A and FIG. 3B are exploded perspective views showing a head chip according to an embodiment of the present invention.
Figure 3A:
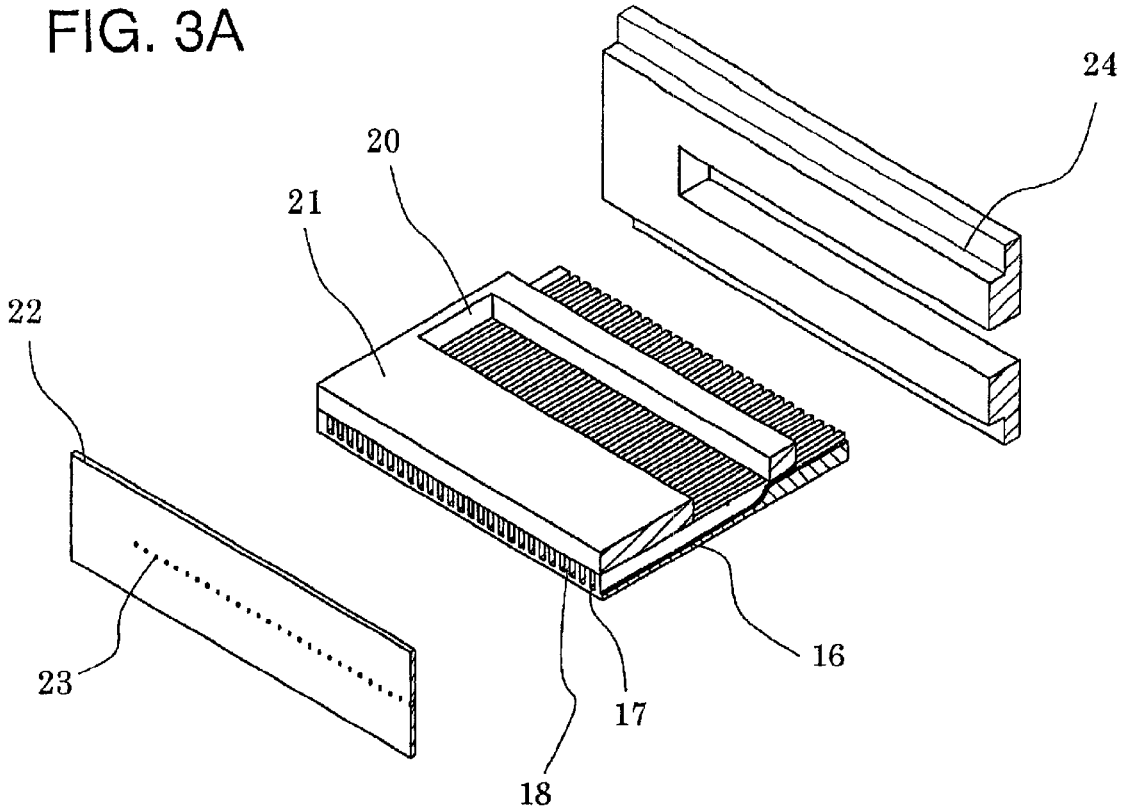
Figure 3B:
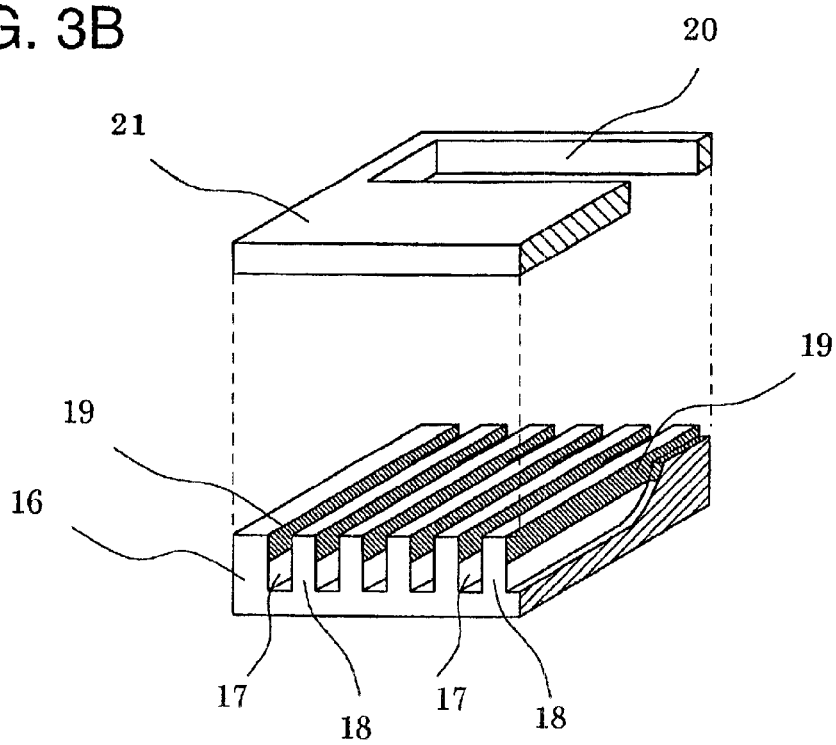

FIG. 1 is an assembly perspective view showing an ink jet head according to an embodiment of the present invention, FIG. 2 is a sectional view showing a principal part of the ink jet head, and FIGS. 3A and 3B are perspective view showing a head chip of the ink jet head.

As shown in FIGS. 1 and 2, the ink jet head 10 of this embodiment is comprised of the head chip 11, a passage forming member 12 disposed at one side of the head chip 11, and a wiring substrate 14 on which a drive circuit for driving the head chip 11 and the like are fabricated. These members are fixed to a base member 15.

First, the structure of the head chip 11 will be described. As shown in FIGS. 3A and 3B, a plurality of channels or grooves 17 are formed in parallel in a piezo-ceramic plate 16 of the head chip 11, and the grooves 17 are separated by side walls 18. On end portion of each groove 17 extends up to one end face of the piezo-ceramic plate 16, whereas the other end portion of each groove 17 does not extend up to the other end face of the piezo-ceramic plate 16 and gradually decreases in depth. The grooves 17 are formed in the piezo-ceramic plate 16 by a disc-shaped dice cutter or the like. The shallow portions of the grooves 17 ar unnecessary, but they are inevitably formed due to the shape of the dice cutter.

Electrodes 19 for applying electric fields to drive the side walls 18 are formed on the side walls 18, which are formed at both sides of the respective grooves 17 in the direction of the width thereof, in the longitudinal direction on the side where the grooves 17 are open.

An ink chamber plate 21, which forms an ink chamber 20 communicating with each groove 17, is joined to the opening side of the grooves 17 in the piezo-ceramic plate 16 on which the grooves 17, the electrodes 19 and the like are formed as stated above. The ink chamber 20 and the respective grooves 17 communicate with each other in proximity to the other end portions of the respective grooves 17 where the depth is decreased.

Although the ink chamber plate 21 may be formed of a ceramic plate, a metallic plate, or the like, it is preferably formed of a ceramic plate whose coefficient of thermal expansion is approximate to that of the piezo-ceramic plate 16 in terms of deformation and the like after the joint with the piezo-ceramic plate 16.

A nozzle plate 22 is joined to the end face of the joined body of the piezo-ceramic plate 16 and the ink chamber plate 21 on the end face where the grooves 17 are open. Nozzle apertures 23 are formed in the nozzle plate 22 in such a position as to face the respective grooves 17.

According to the present embodiment, the area of the nozzle plate 22 is larger than that of the end face of the joined body of the piezo-ceramic plate 16 and the ink chamber plate 21 on the side where the grooves 17 are open. The nozzle plate 22 is constructed by forming nozzle apertures 23 in polyimide film or the like by using, e.g. an excimer laser apparatus. Although not illustrated, a water-repellent film is formed at one side of the nozzle plate 22, which faces a printed matter, in order to prevent the adhesion of ink and the like.

According to this embodiment, a nozzle support plate 24 is disposed around the end portion of the joined body of the piezo-ceramic plate 16 and the ink chamber plate 21 on the side where the grooves 17 are open. The nozzle support plate 24 is used to stably hold the nozzle plate 22. The nozzle support plate 24 is joined to outer side of the end face of the joined body of the nozzle plate 22, and is fixed to the base member 15.

Figure 4:
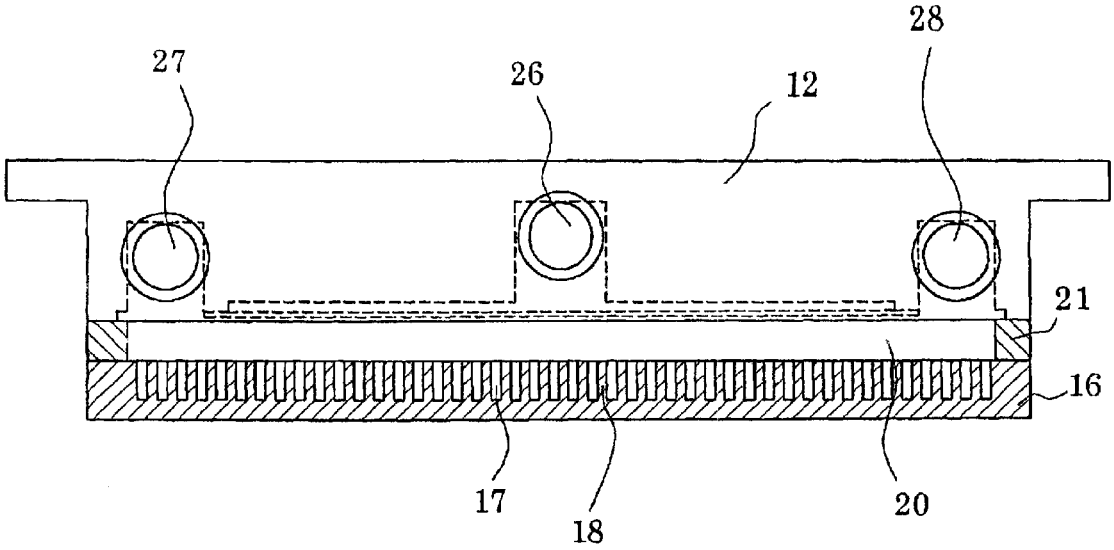
FIG. 4 is a schematic sectional view showing a principal part of a head chip according to an embodiment of the present invention.
Figure 5:
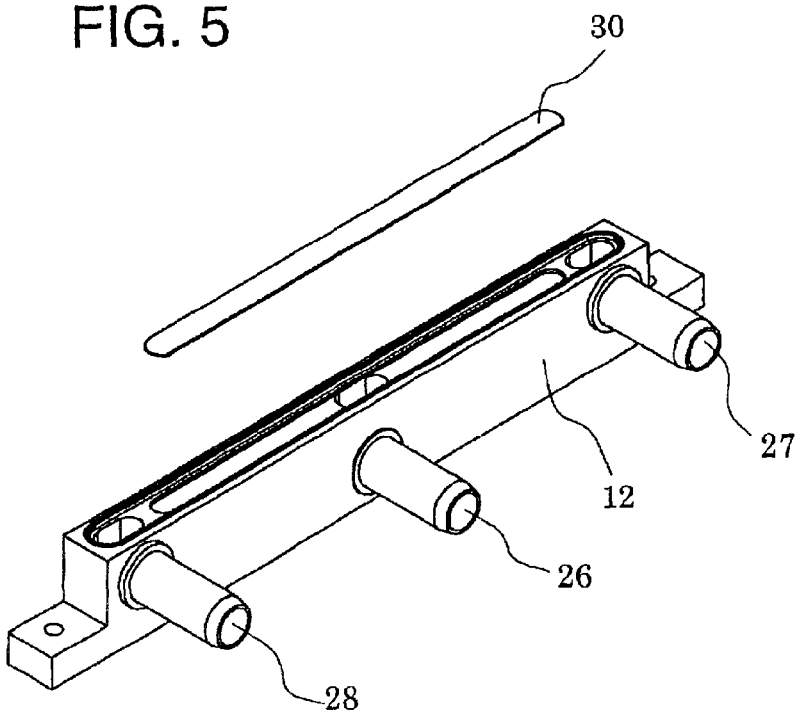
FIG. 5 is a perspective view showing a passage forming member according to an embodiment of the present invention.

The passage forming member 12 is joined to one side of the ink chamber plate 21 constituting the head chip 11 by an adhesive agent or the like as shown in FIG. 4. One side of the ink chamber 20 is sealed by the passage forming member 12. The passage forming member 12 is fixed in such a manner as to be tightly joined to the ink chamber 20. For example, an O-ring may be provided between the ink chamber plate 21 and the passage forming member 12, and the passage forming member 12 may be fastened by a screw member or the like. The passage forming member 12 now will be described. As shown in FIGS. 4 and 5, in the substantially central area of the passage forming member 12 in the longitudinal direction, there is provided an ink supply passage 26 that constitutes a part of an ink passage, which connects an ink storage means (not illustrated) for storing ink in an ink tank or the like to the ink chamber 20. In their respective regions in proximity to both ends of the passage forming member 12 in the longitudinal direction thereof, there are provided ink discharge passages or communicating passages 27 and 28 that connect the ink chamber 20 to the outside so as to discharge the ink from the ink chamber 20 to the outside. Each of the communicating passages 27 and 28 is independent from the ink supply passage 20 so that ink supplied into the ink chamber 20 through the ink supply passage 26 does not pass through at least a portion of each of the communicating passages 27 and 28 (e.g., a portion of each of the communicating passages 27, 28 extending from an exterior surface of the passage forming member 12).

The ink supply passage 26 is provided with an air tank 29 that adjusts the negative pressure of the ink supplied to each head chip so that the negative pressure of the ink supplied to the ink chamber 20 from the ink storage means can be constant. A filter 30 is provided at the end of the ink supply passage 26 by the side of the ink chamber 20. The ink is supplied into the ink chamber 20 after the dust is removed by the filter 30 to a certain degree.

On the other hand, according to this embodiment, a check valve 31 is provided in each of the communication passages 27 and 28 formed in the regions corresponding to both ends of the ink chamber 20 in the longitudinal direction. The check valve 31 permits only a flow from the ink chamber 20 to the outside so that the ink in the ink chamber 20 can be discharged to the outside through the communication passage 27 and 28 without being exposed to the air. Although described later in further detail, the unwanted substances included in the ink in the ink chamber 20 and the grooves 17 is removed by absorbing the ink in the ink chamber 20 and the grooves 17 through at least one of the communication passages 27 and 28 when the ink jet head is manufactured, maintained, or the like. It should be noted that in this description the word "unwanted substances" includes, for example, dust particles and bubbles.

When the ink is absorbed, it is necessary to continuously supply the ink into the ink chamber 20 and the grooves 17 so as to prevent the air from being absorbed into the ink chamber 20 and the grooves 17 through the nozzle apertures 23, etc. According to the present embodiment, when the ink is absorbed, a container for storing ink therein is disposed in the ink jet head 10 by the side of the nozzle plate 22, and the nozzle plate 22 is immersed in the ink so that the ink can flow into the grooves 17 through the nozzle apertures 23 by absorption through the communicating passages 27 and 28. It is to be understood, however, that the method for supplying the ink into the ink chamber 20 and the grooves 17 is not restricted to the above-described one. For example, the ink may be supplied from an ink storage means through the ink supply passage 26 with the nozzle apertures 23 being sealed.

Figure 6A:
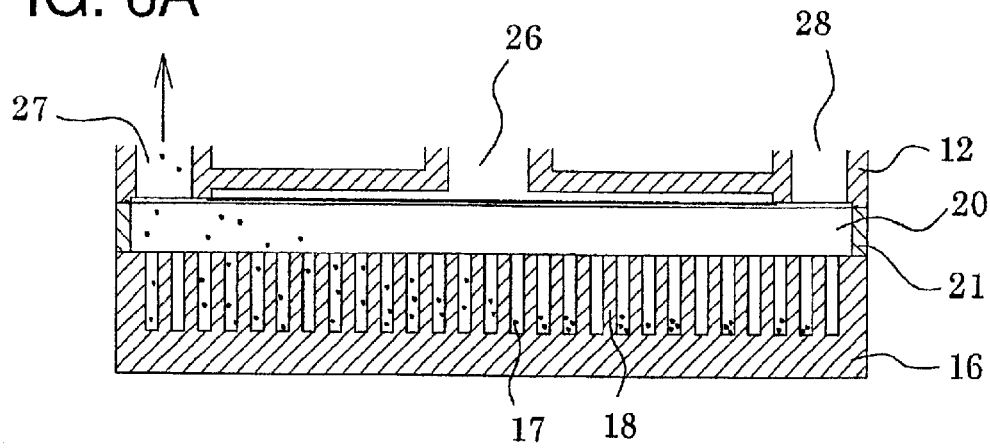
FIG. 6A through FIG. 6C are schematic diagrams showing the procedure for removing dust according to an embodiment of the present invention.
Figure 6B:
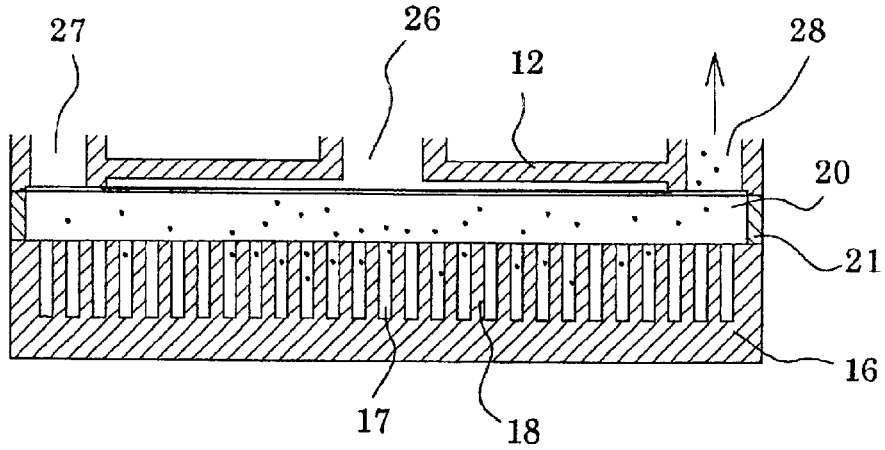
Figure 6C:
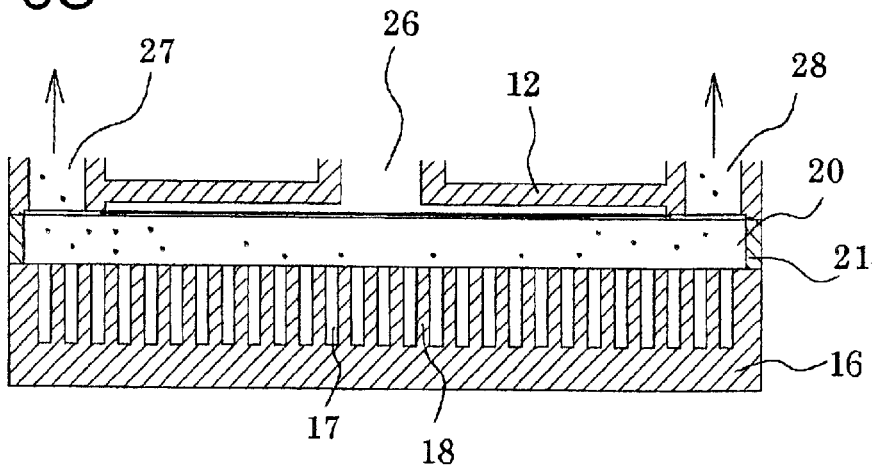
Figure 7:
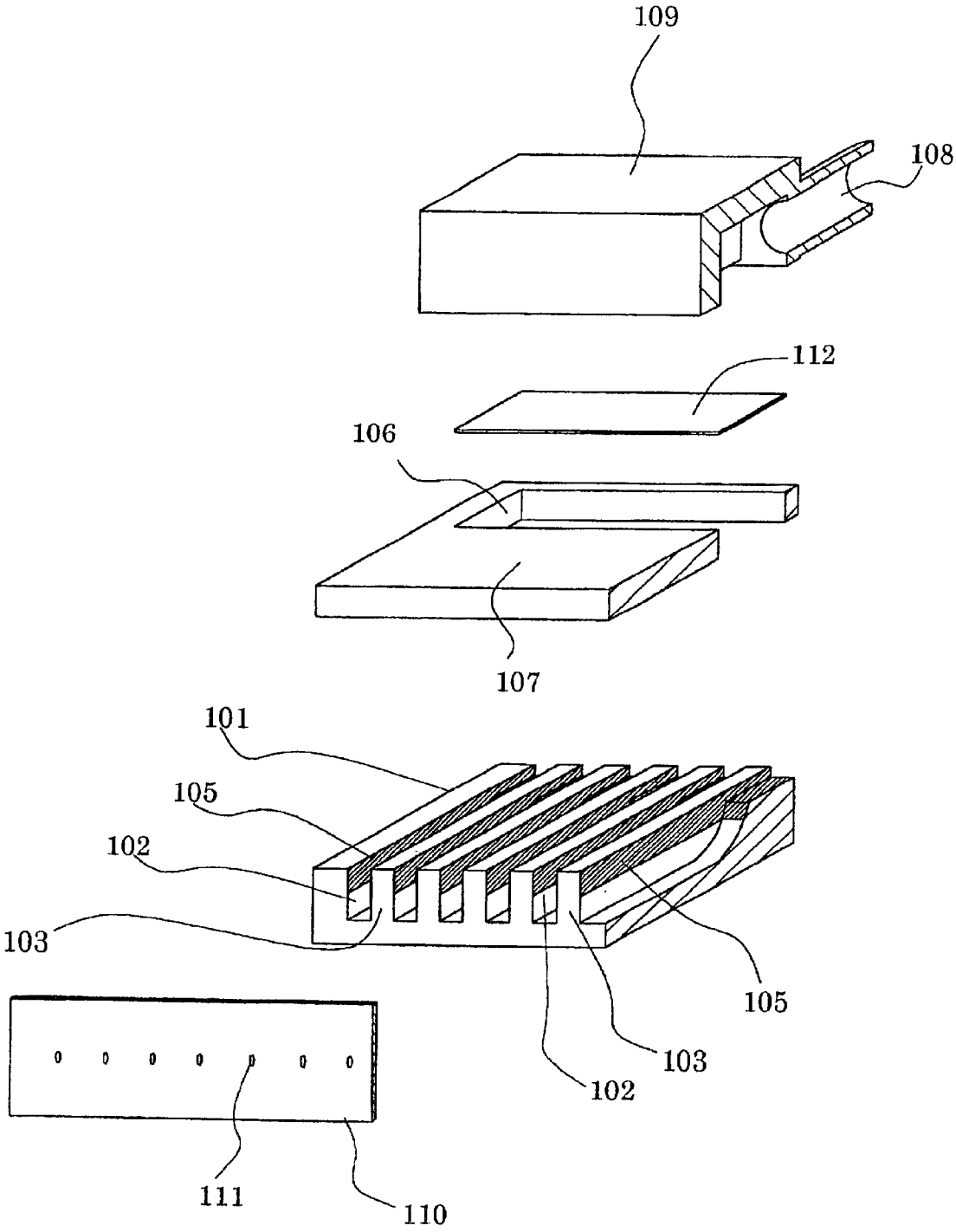
FIG. 7 PRIOR ART
FIG. 7 is an exploded perspective view showing the outline of an ink jet head according to the prior art.

Although there are no particular limitations regarding the procedure for removing the dust by absorbing the ink, it is preferable to carry out a stirring step for absorbing the ink through the communicating passages 27 and 28 with different timings and stirring the ink contained in the ink chamber 20 and the grooves 17. An example of the procedure for removing the dust will now be described. FIGS. 6A through 6C are diagrams explaining the procedure for removing the dust. The structure of the passage forming member 12 shown in FIGS. 6A through 6C is slightly different from the actual structure.

In the procedure for removing the dust according to this embodiment, the stirring step for stirring the dust in the ink is carried out first. Specifically, as shown in FIG. 6A, the ink contained in the ink chamber 20 and the grooves 17 is absorbed through one communicating passage 27. This absorbs the dust in the vicinity of the communicating passage 27 as well as the ink, and generates a flow in the ink to stir the dust included in the grooves 17 at the center. The dust included in the ink is schematically indicated by the dots in the figures.

According to this embodiment, the check valve 31 provided in each of the communicating passages 27 and 28 prevents the air from coming into the ink chamber 20 through one communicating passage 28 when the ink is absorbed through the other communicating passage 27. Therefore, the ink is supplied into the grooves 17 and the ink chamber 20 through the nozzle apertures 23 such that the grooves 17 and the ink chamber 20 are constantly filled with the ink.

As shown in FIG. 6B, the ink in the ink chamber 20 and the grooves 17 is then absorbed through the communicating passage 28. This generates a flow in the ink in a direction reverse to the flow generated by absorption through the communicating passage 27, so that the dust in the grooves 17 can be further stirred.

Although the ink is absorbed to such an extent as to remove the dust in the vicinity of the communicating passages 27 and 28 in the stirring step according to this embodiment, the dust should not necessarily be absorbed in the stirring step insofar as the flow can be generated in the ink to stir the dust in the grooves 17. Therefore, the ink may be absorbed a plurality of times through the respective communicating passages 27 and 28 alternately with a relatively weak absorbing power.

After the dust included in the ink is stirred in the stirring step as stated above, a dust absorption step is carried out. Specifically, the ink in the ink chamber 20 and the grooves 17 is absorbed through both communicating passages 27 and 28 in FIG. 6C, and this absorbs the ink and the stirred dust to reliably remove the dust from the ink chamber 20 and the grooves 17. It is needless to say that the ink may be absorbed only through one communicating passage with the other communicating passage being sealed.

As stated above, according to this embodiment, the passage forming member 12 is provided with the communicating passages 27 and 28 that connect the ink chamber 20 to the outside. When, for example, the head is manufactured, the ink contained in the ink chamber 20 and the grooves 17 is absorbed through the communicating passages 27 and 28 so as to remove the dust from the ink. It is therefore possible to remove the dust reliably and relatively easily even if the dust cannot be removed by absorption through the nozzle apertures 23. Moreover, bubbles can be removed from the ink at the same time. It is therefore possible to uniformalize the characteristics of the ink discharged through the respective nozzle apertures 23 and to maintain the satisfactory ink discharge characteristics.

According to this embodiment, the check valve 31 is provided in each of the communicating passages 27 and 28 so as to prevent the air from coming into the ink chamber 20 through the communicating passages 27 and 28. Alternatively, the communicating passages 27 and 28 may be sealed by securing a cap member thereto through an O-ring or the like without providing the check valve 31.

Although the passage forming member 12 is provided with two communicating passages 27 and 28 according to this embodiment, the number of communicating passages is not restricted to two. For example, the passage forming member 12 may be provided with three or more communicating passages, or only one communicating passage.

It should be noted that the wiring substrate 14, on which a drive circuit and the like are fabricated, is fixed on the base member 15 to which the above-described ink jet head 10 is fixed, and the wiring substrate 14 and a wiring 19 of the head chip 11 are connected with each other via a flexible cable 32 or the like and mounted on a carriage of the ink jet recording apparatus.

Although the ink contained in the ink chamber 20 and the grooves 17 is absorbed through the communicating passages 27 and 28 when, for example, the ink jet head is manufactured according to the present embodiment, the method for absorbing the ink is not restricted to this. For example, the ink jet recording apparatus may be provided with the above-described ink jet head 10 and an absorbing means such as a vacuum pump that is connected to the communicating passages 27 and 28 of each ink jet head 10 so that the ink contained in the ink chamber 20 and the grooves 17 can be absorbed with predetermined timings.

Although such an absorbing means may be additionally provided in the ink jet recording apparatus, it is possible to use the absorbing means that is used for the so-called cleaning operation in which the ink is absorbed through the nozzle apertures.

As stated above, the ink jet recording apparatus is provided with the ink jet head having the communicating passages and the absorbing means so that the ink contained in the ink chamber and the grooves can be absorbed with predetermined timings through the communicating passages. It is therefore possible to reliably remove the dust included in the ink contained in the ink chamber and the grooves, thus maintaining the excellent printing quality and improving the durability.

As set forth hereinabove, according to the present invention, the passage forming member constituting the ink jet head is provided with the communicating passages that connect the ink chamber to the outside. It is therefore possible to reliably remove the dust included in the ink by absorbing the ink in the ink chamber and the grooves through the communicating passages.

What is claimed is:

1. An ink jet head comprising:

a substrate; a plurality of partition walls disposed on a main surface of the substrate and spaced apart at a preselected interval to form a plurality of channels each for receiving ink; an ink chamber plate connected to the substrate to define with the partition walls an ink chamber for supplying ink to the channels; and a passage forming member connected to the ink chamber plate and having an ink supply passage disposed in communication with the ink chamber for supplying ink contained in an ink storage device to the ink chamber and at least one ink discharge passage for discharging ink from the ink chamber, the ink discharge passage being independent from the ink supply passage so that ink is supplied directly to the ink chamber through the ink supply passage without passing through at least a portion of the ink discharge passage.

2. An ink jet head according to claim 1; wherein the ink discharge passage extends along a longitudinal direction of the ink chamber.

3. An ink jet head according to claim 1; further comprising a check valve disposed in the ink discharge passage to permit the flow of ink from the ink chamber in only one direction.

4. An ink jet head according to claim 1; further comprising sealing means for sealing the ink discharge passage to prevent the discharge of ink from the ink discharge passage.

5. An ink jet head according to claim 4; wherein the sealing means comprises a cap member and an O-ring.

6. An ink jet head according to claim 1; further comprising a filter disposed between the ink supply passage and the ink chamber for filtering the ink supplied from the ink storage device to the ink chamber.

7. An ink jet recording apparatus comprising: an ink jet head according to claim 1; and absorbing means for absorbing the ink in the ink chamber through the ink discharge passage.

8. An ink jet head comprising:

a substrate having an ink chamber for storing ink and a plurality of channels disposed in communication with the ink chamber for receiving ink from the ink chamber; and a passage forming member connected to the substrate and having an ink supply passage disposed in communication with the ink chamber for supplying ink contained in an ink storage device to the ink chamber and at least one ink discharge passage for discharging ink from the ink chamber, the ink discharge passage being independent from the ink supply passage so that ink is supplied directly to the ink chamber through the ink supply passage without passing through at least a portion of the ink discharge passage.

9. An ink jet head according to claim 8; wherein the at least one ink discharge passage comprises two ink discharge passages.

10. An ink jet head according to claim 8; wherein the substrate has a plurality of partition walls spaced apart at a preselected interval to form the channels, each of the partition walls having a pair of deformable side walls; and further comprising a plurality of electrodes each connected to respective ones of the side walls of the partition walls and driven by a voltage signal to deform the side walls to vary the volume in the channels to thereby eject ink from the channels.

11. An ink jet recording head according to claim 10; comprising a nozzle plate connected to the substrate and having a plurality of nozzle openings each disposed in communication with respective ones of the channels so that when the electrodes are driven by a voltage signal ink is ejected from the channels through the nozzle openings.

12. An ink jet head according to claim 8; further comprising a check valve disposed in the ink discharge passage to permit the flow of ink from the ink chamber in only one direction.

13. An ink jet head according to claim comprising sealing means for sealing the ink discharge passage to prevent the discharge of ink from the ink discharge passage.

14. An ink jet head according to claim 13; wherein the sealing means comprises a cap member and an O-ring.

15. An ink jet head according to claim 8; further comprising a filter disposed between the ink supply passage and the ink chamber for filtering the ink supplied from the ink storage device to the ink chamber.

16. An ink jet recording apparatus comprising: an ink jet head according to claim 8; and absorbing means for absorbing the ink in the ink chamber through the ink discharge passage.

17. An ink jet head comprising:

a substrate having an ink chamber for storing ink and a plurality of channels disposed in communication with the ink chamber for receiving ink from the ink chamber; and a passage forming member connected to the substrate and having an ink supply passage disposed in communication with the ink chamber for supplying ink contained in an ink storage device to the ink chamber, at least one ink discharge passage for discharging ink from the ink chamber, a main surface through which the ink supply passage and the ink discharge passage extend, and a side surface having a plurality of openings each disposed in communication with a respective one of the ink supply passage and the ink discharge passage, the side surface of the passage forming member being connected to the substrate so that the openings are disposed in communication with the ink chamber.

18. An ink jet head comprising:

a substrate having an ink chamber for storing ink and a plurality of channels disposed in communication with the ink chamber for receiving ink from the ink chamber; and a passage forming member connected to the substrate and having an ink supply passage disposed in communication with the ink chamber for supplying ink contained in an ink storage device to the ink chamber and two ink discharge passages for discharging ink from the ink chamber, the ink discharge passages disposed at opposite end portions of the passage forming member corresponding to opposite end portions of the ink chamber.

* * * * *